United States Patent [19]

Chaffers

[11] 4,383,636

[45] May 17, 1983

[54] CONTAINER

[75] Inventor: John M. Chaffers, Santa Ana, Calif.

[73] Assignee: Champion International Corporation, Stamford, Conn.

[21] Appl. No.: 271,395

[22] Filed: Jun. 8, 1981

[51] Int. Cl.[3] ..... B65D 43/02; B65D 5/54; B65D 5/68

[52] U.S. Cl. ..... 229/32; 229/43; 229/30

[58] Field of Search ..... 229/32, 30, 34 R, 43

[56] References Cited

U.S. PATENT DOCUMENTS

| | | | |
|---|---|---|---|
| 1,913,597 | 6/1933 | Jones | 229/43 |
| 1,974,527 | 9/1934 | Bliss | 229/43 |
| 2,297,284 | 9/1942 | Blackman | 229/43 |
| 2,334,902 | 11/1943 | Bultery | 229/32 |
| 2,734,677 | 2/1956 | Arneson | 229/32 |
| 3,131,848 | 5/1964 | Floyd | 229/43 |
| 3,314,585 | 4/1967 | Farrer | 229/43 |
| 3,448,914 | 6/1969 | Scholz | 229/32 |
| 3,510,051 | 5/1970 | Nordstrom | 229/43 |
| 3,580,478 | 5/1971 | Bemiss | 229/43 |
| 3,810,573 | 5/1974 | Russell | 229/32 |

*Primary Examiner*—Herbert F. Ross

*Attorney, Agent, or Firm*—Evelyn M. Sommer; John H. Mulholland

[57] ABSTRACT

An improved container comprising an open tray assembly and a cover assembly which is placed over the open tray assembly after the open tray assembly is packed with articles, such as fresh produce. Side flaps on the cover assembly are folded over and attached to the side walls of the tray assembly. The top panel of the cover assembly has an opening and is provided with tear lines adjacent said opening to form closure panels which will permit the cover to be easily opened and reclosed.

9 Claims, 15 Drawing Figures

CONTAINER

BACKGROUND OF THE INVENTION

The present invention relates to an improved container and more particularly to an improved container which is particularly useful for packaging perishable articles, such as fresh produce.

Historically, fresh produce has been packaged in wooden crates or cartons. However, in view of the cost of purchasing such wooden crates, as well as the cost of shipping and storing them, fresh produce has more recently been packaged in lightweight corrugated fiberboard containers which are inexpensive to manufacture, light-weight and may be shipped to the user in flattened form.

However, one drawback of such earlier fiberboard produce containers, is the fact that some users did not consider such containers strong enough to withstand handling. Moreover, if the containers were made of thicker materials or of multiple thickness fiberboard to strengthen them, the containers were not readily able to be opened and reclosed if it were necessary to inspect the contents.

SUMMARY OF THE INVENTION

The present invention overcomes these drawbacks and has for one of its objects the provision of an improved container strong enough to withstand handling during shipment.

Another object of the present invention is the provision of an improved container which has means for easily opening and reclosing the cover so that the contents of the container may be inspected.

Other and further objects of the invention will be obvious upon an understanding of the illustrative embodiment about to be described, or will be indicated in the appended claims, and various advantages not referred to herein will occur to one skilled in the art upon employment of the invention in practice.

In accordance with the present invention, the container comprises an open tray assembly and a cover assembly. The open tray assembly has bottom and side walls as well as end walls which are multiple thickness for extra strength and is provided with top flaps extending upwardly from the end walls. After the open tray assembly is filled with articles, the cover assembly is placed over the mouth of the open tray assembly. The cover assembly has side flaps extending therefrom which are folded down and are attached to the side walls of the tray assembly so as to give the side walls thereof extra thickness and strength. Thereafter, the top flaps which extend upwardly from the end walls of the tray assembly are folded over the outer top wall areas of the cover assembly and are attached thereto. This will provide the side walls, the end walls and the outer top wall areas of the cover with multiple thicknesses to give the container the extra strength needed to withstand handling.

The inner top wall area of the cover portion may remain single thickness and has an opening therein. Tear lines are provided at right angles to the opening to form closure panels in the inner top wall area so that the top wall inner areas may be torn along the tear lines to permit the closure panels to be peeled back for access to the contents of the container. The closure panels may then be re-folded down to reclose the container.

DESCRIPTION OF THE DRAWINGS

A preferred embodiment of the invention has been chosen for purposes of illustration and description and is shown in the accompanying drawings forming a part of the specification, wherein.

DETAILED DESCRIPTION

The container 1 (FIG. 5) of the present invention comprises an open tray assembly 2 (FIG. 3) and a cover assembly 3 adapted to be placed over the open tray assembly 2 (FIG. 4) after the open tray assembly 2 has been filled with articles, such as fresh produce.

Figure 1:
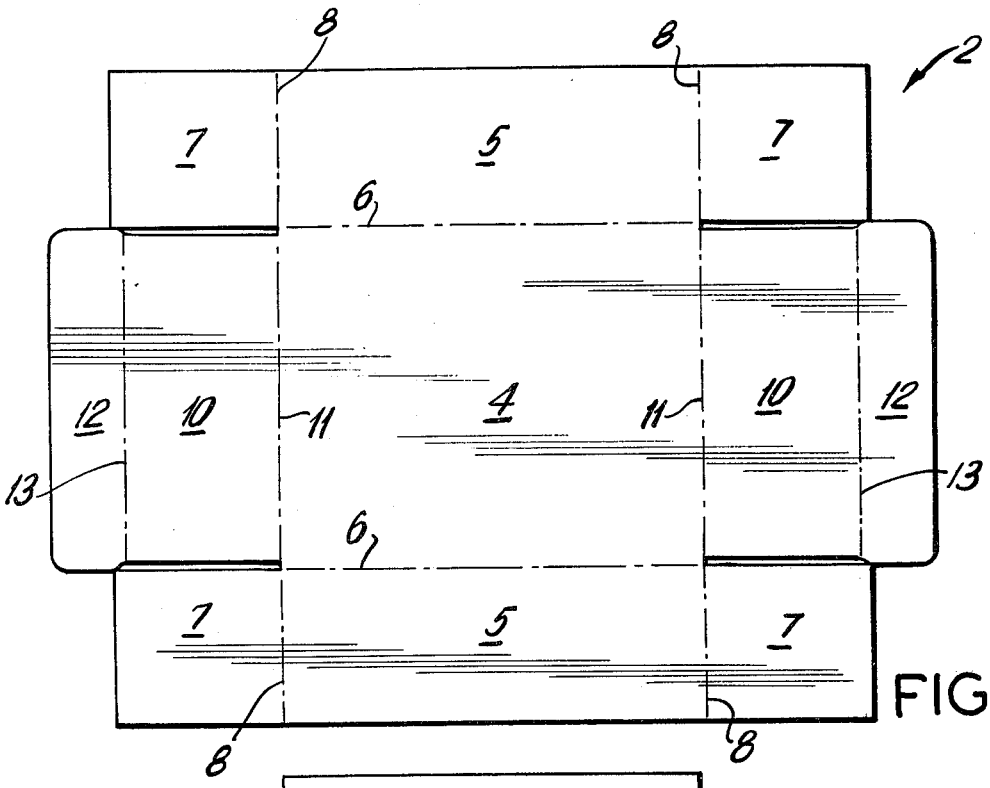
FIG. 1 is a plan view of a blank which may be used to form the open tray assembly of the present invention.

The open tray assembly 2 is formed from a blank (FIG. 1) which may be made of corrugated fiberboard and which may be die cut and creased by automatic machinery. The open tray assembly blank 2 comprises a bottom panel 4 having a pair of side wall panels 5 extending therefrom from opposite side edges thereof and foldable relative thereto along fold lines 6 to form the side walls 5 of the tray 2. Each side wall panel 5 has a pair of end flaps 7 extending therefrom and foldable relative thereto along fold lines 8.

The bottom wall panel 4 of the tray assembly blank 2 has a pair of end wall panels 10 extending from opposite end edges thereof and foldable relative thereto along fold lines 11 to form the upstanding end walls 10 of the tray 2. Each end wall panel 10 has a top flap panel 12 extending outwardly therefrom and foldable relative thereto along fold line 13, for a purpose which will be referred to in greater detail hereinbelow.

Figure 3:
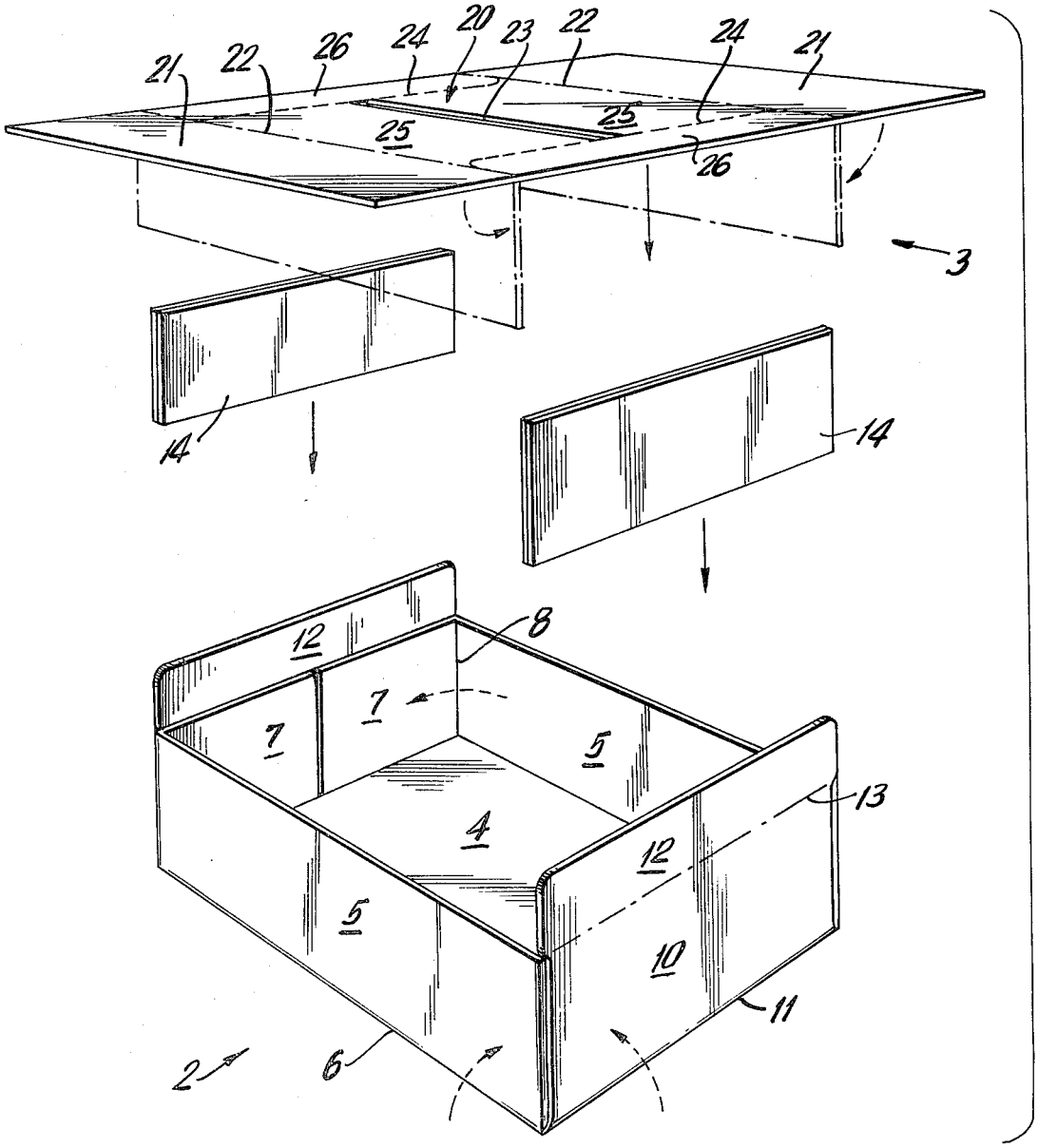
FIG. 3 is an exploded perspective view of the components of the container of the present invention.

When the open tray assembly 2 is to be assembled as shown in FIG. 3, the side wall panels 5 of the blank are folded upwardly along fold lines 6 to form side walls 5 and the end flap panels 7 are folded inwardly along fold lines 8. The end wall panels 10 are then folded upwardly along fold lines 11 so that they are positioned adjacent the folded end flaps 7. The inner faces of the end walls 10 are attached to the outer faces of the end flaps 7 by an adhesive or in any other desired manner. Preferably, the widths of the end flaps 7 are substantially equal to the heights of the end walls 10 so that the flaps 7 substantially cover the end walls 10 when folded. An additional end wall support panel 14 may be placed within the tray 2 adjacent the inner faces of the end flaps 10 and attached thereto by an adhesive or in any other desired manner to give the end walls of the tray multiple thickness. The support panels 14 may be made of a double thickness, as shown, or may be of a single thickness, if desired, and are preferably substantially the same height as the end flap 7 to cover them entirely when adhered in place. The tray assembly can be constructed without any support panel 14 and function equally as well.

Figure 2:
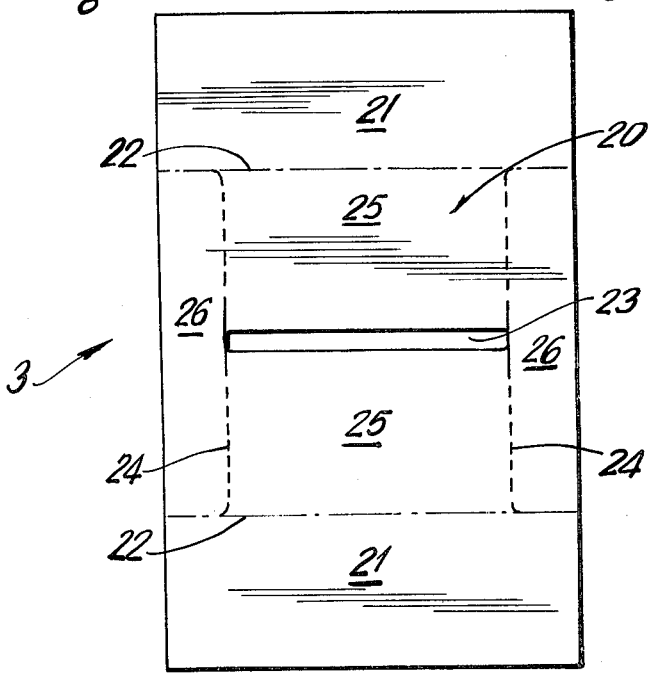
FIG. 2 is a plan view of a blank which may be used to form the cover assembly of the present invention.

The cover assembly 3 is formed from a blank (FIG. 2) having a top wall panel 20 and a pair of side flap panels 21 extending outwardly therefrom and foldable relative thereto along fold lines 22. The top wall panel 20 has an elongated opening 23 therein and is provided with perforated tear lines 24 substantially at right angles to opening 23 and extending substantially across the entire width of the top wall panel 20 between opposite fold lines 22 to divide the top wall panel 20 into central closure panels 25 and outer top wall areas 26 on either side of the closure panels 25. Preferably, the width of each outer top wall area 26 in the cover assembly 3 is approximately equal to the height of each top flap 12 in the tray assembly 2.

Figure 4:
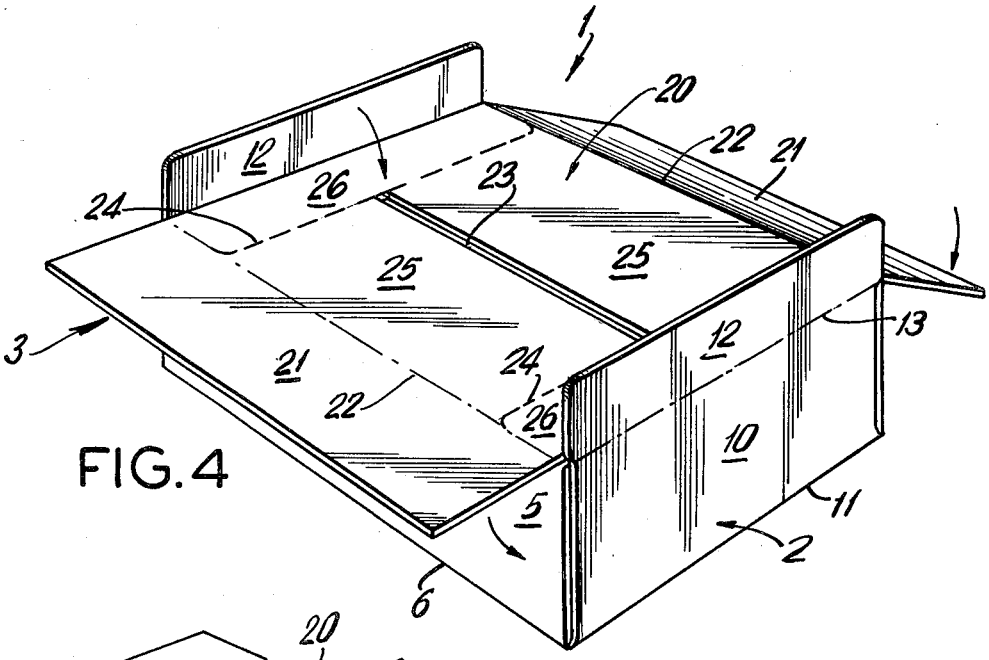
FIG. 4 is a perspective view of the container of the present invention before the cover assembly is attached to the tray assembly.
Figure 5:
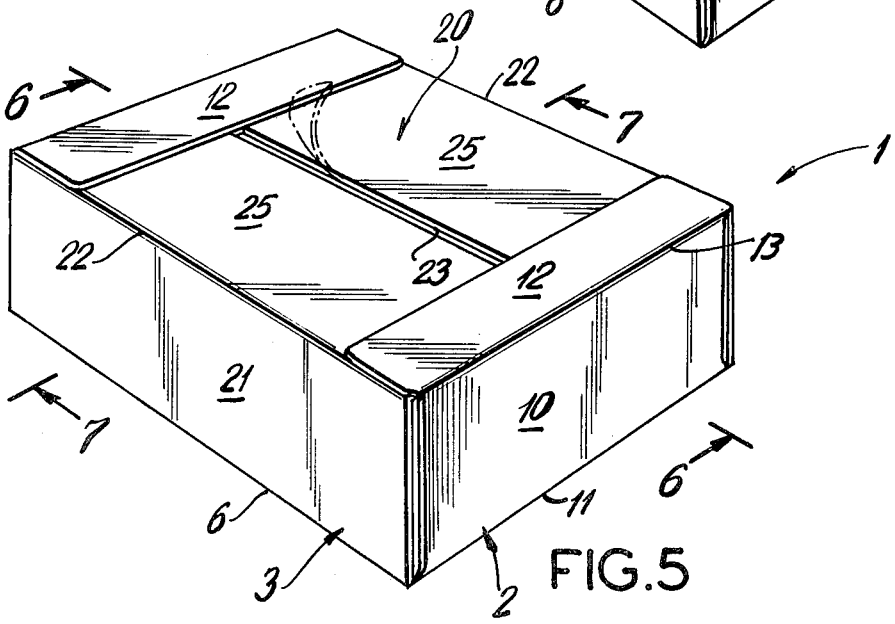
FIG. 5 is a perspective view of the finished container of the present invention.
Figure 6:
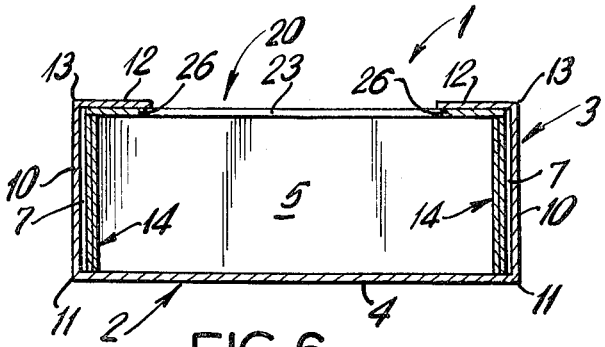
FIG. 6 is a sectional view taken along line 6—6 of FIG. 5.
Figure 7:
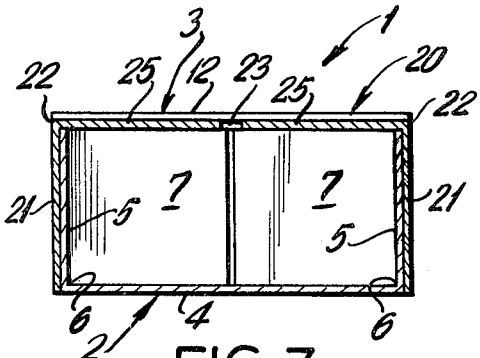
FIG. 7 is a sectional view taken along line 7—7 of FIG. 5.
Figure 8:
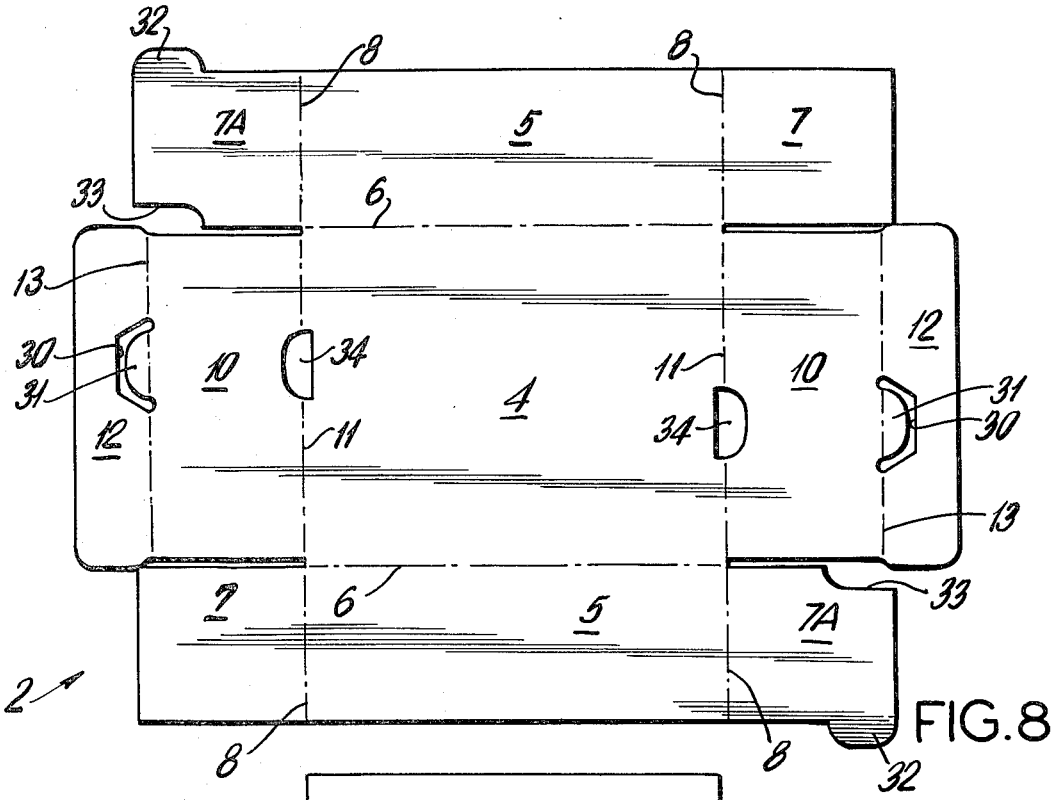
FIG. 8 is a plan view of a blank which may be used for forming the tray assembly of a modification of the present invention.
Figure 9:
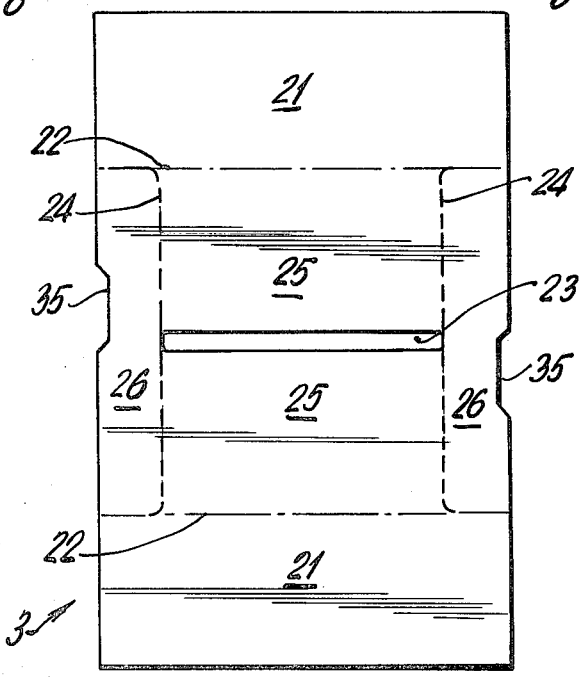
FIG. 9 is an elevational view of a blank which may be used for forming the cover assembly of the modification of the present invention.

After the assembled tray 2 is filled with articles, such as fresh produce, the cover assembly 3 is placed over the tray 2 and the side flaps 21 thereof are folded down along fold lines 22 so that they overlie the side walls 5 of the tray 2 (FIG. 4). The side flaps 21 of the cover assembly 3 are attached to the outer surfaces of the side walls 5 of the tray assembly 2 by an adhesive or in any other desired manner. The height of the side flaps 21 are substantially the same as the height of the side walls 5 so as to cover them completely when folded over. The top flaps 12 extending upwardly from the end walls 10 of the tray assembly 2 are then folded down along fold lines 12 to overlie the outer top wall areas 26 of the top wall panel 20 of the cover assembly 3 and are attached thereto by an adhesive or in any other desired manner to complete the container (FIG. 5). The completed container 1 is provided with multiple thickness side walls (5–21), end walls (10–7–14) and outer top wall areas (12–26) with the closure panels 25 between the top wall end areas 12 and 26 remaining single thickness.

When it is desired to gain access to the container interior, the user inserts his hand in opening 23 to tear the closure panels 25 of the top wall 20 along the tear lines 24 and peels the closure panels 25 back relative to fold lines 22, as shown in dotted lines in FIG. 5. These closure panels 25 may then be folded back down to their original positions to reclose the container.

While this invention has been described with respect to an "end slot" tray in which the side walls 5 have end flaps 7 extending therefrom which are adhered to the end walls 10, it will be understood that it is within the purview of the present invention to use a "side slot" tray in which the end walls have end flaps extending therefrom which are adhered to the side walls. Furthermore, while the container is shown in the drawing as being rectangular, it will be understood that the container may be square, without departing from the invention.

FIGS. 9 through 15 show a modification of the present invention and particularly the use of the present invention in a stacking container, somewhat in the manner shown in U.S. Pat. No. 4,175,691 dated Nov. 27, 1979 and owned by the assignee of the present invention. The container 1 shown and described in the modification of FIGS. 9 through 15 is substantially identical to the container shown in FIGS. 1 to 7 and the same reference numerals will be used for like parts in both versions of the invention.

In the modification of FIGS. 9 through 15, the top flap panels 12 have an arcuate slot 30 therein to form a stack tab 31 which extends from the fold line 13 outwardly toward the outer edge of the top flap panels 12. It will be noted that the stack tabs 31 on opposed top flaps 12 are off-center and offset from each other with respect to the centerline of the bottom wall panel 4 for a purpose which will be referred to hereinafter in greater detail.

One end flap 7A extending from each side wall 5 and diagonally opposed to each other is provided with a stack tab 32 extending outwardly from the outer edges of each end flap 7A. Each of these diagonally opposed end flaps 7A are also provided with an arcuate open stack slot 33 at the outer edge thereof and in alignment with the stack tabs 32. Each end wall panel 10 is provided with offset arcuate stack slots 34 which extend across fold line 11 into bottom wall panel 4 and are in alignment with the stack tabs 31 extending from each end wall panel 10.

The open tray 2 shown in the modification of FIGS. 8 to 15 is assembled in a manner similar to the manner of assembling the open tray 2 shown in FIGS. 1 to 7. The upstanding side walls 5 are bent upwardly along fold line 6 and the end flaps 7 are bent inwardly. The end walls 10 are then bent upwardly so that the stack slots 34 in the end walls 10 are superimposed over and coincide with the stack slots 33 in the end flaps 7A and the stack tabs 32 in the end flaps 7A coincide with and are superimposed over the stack tabs 31 in the top flaps 12. Since the end flaps 7 and 7A are approximately half the length of the end walls 10, by making the stack tabs 31 and stack slots 34 in the top flap 12 and end walls 10, respectively, offset and off-center, they will coincide and will be superimposed over the stack tabs 32 and stack slots 33 in end flap 7A. The end flaps 7 and 7A are then adhered or otherwise secured to the inner faces of the end walls 10, and if desired, support panels 14 may be adhered to the inner faces of the end flaps 7 and 7A.

Figure 10:
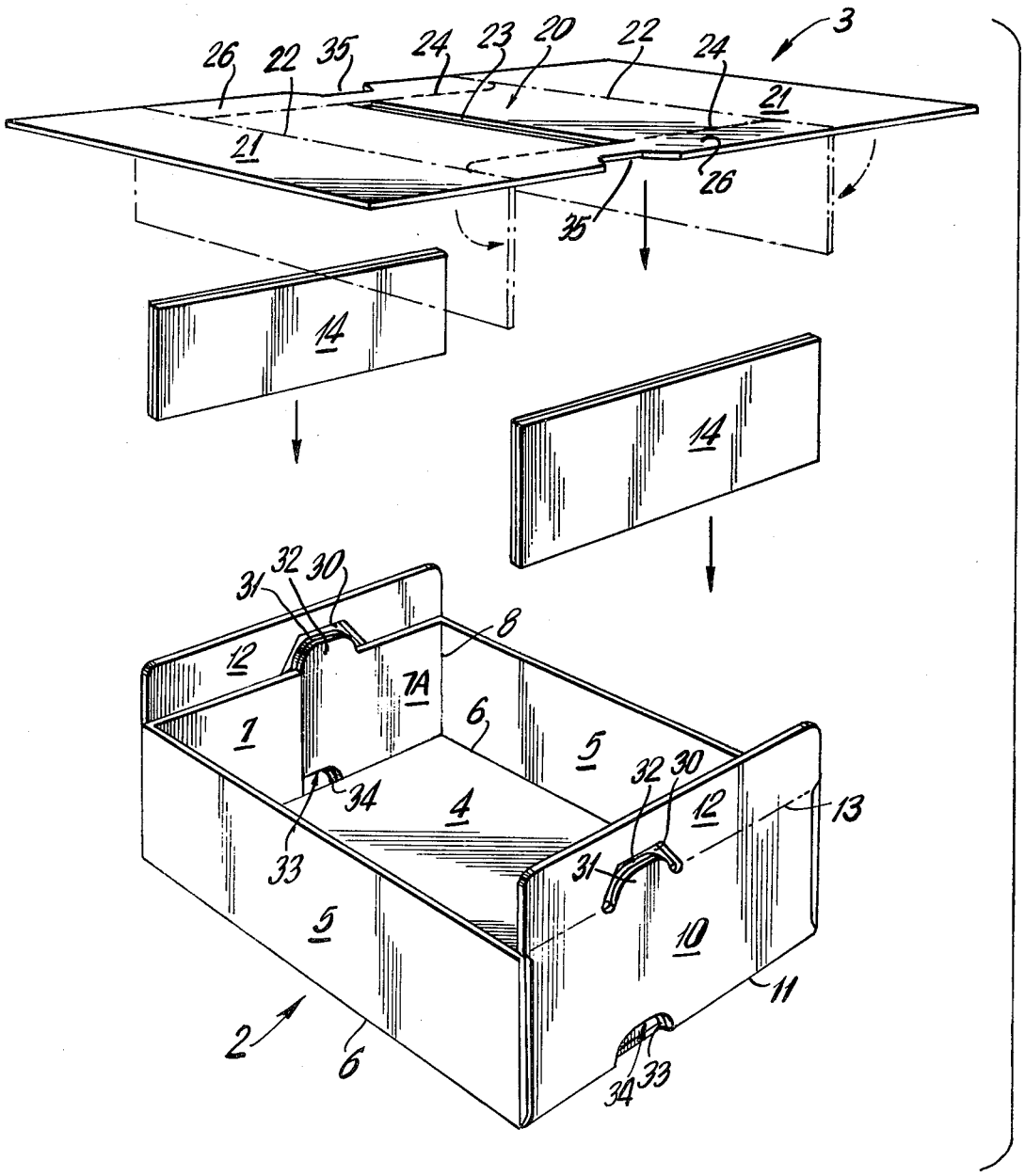
FIG. 10 is an exploded perspective view showing the position of the parts before assembly of the modification of the present invention.
Figure 11:
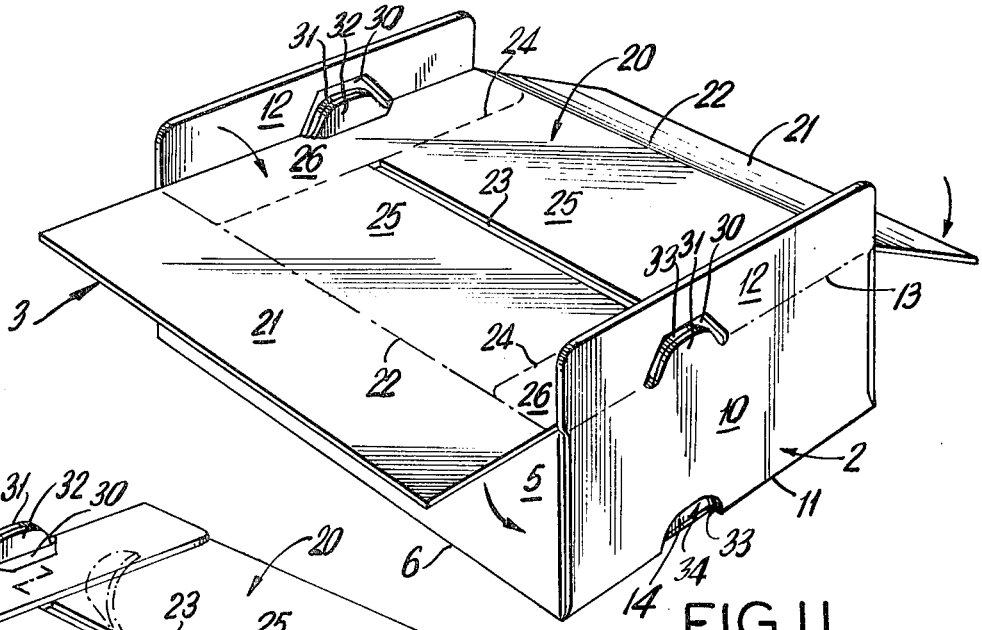
FIG. 11 is a perspective view showing the position of the cover assembly over the tray assembly before sealing in the modification of the present invention.
Figure 12:
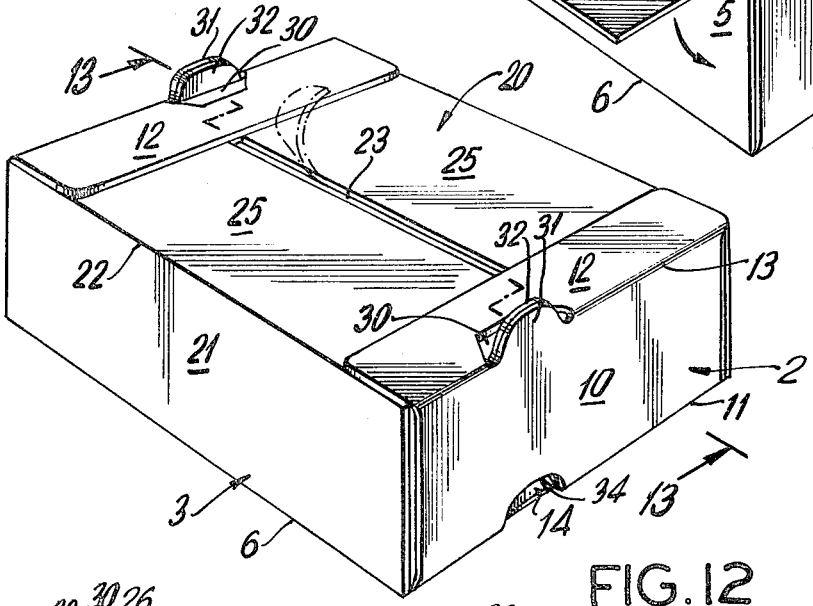
FIG. 12 is a perspective view of the completed container made in accordance with the modification of the present invention.
Figure 13:
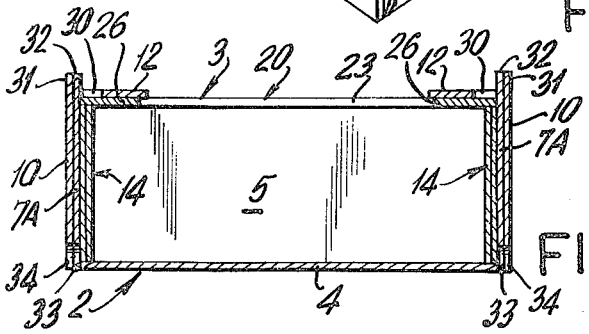
FIG. 13 is a sectional view taken along line 13—13 of FIG. 12.
Figure 14:
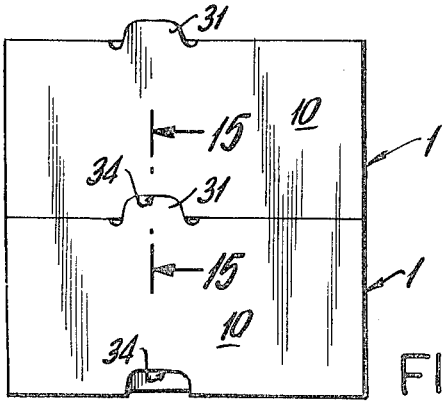
FIG. 14 is a side elevational view showing a pair of containers in stacked relationship to each other.
Figure 15:
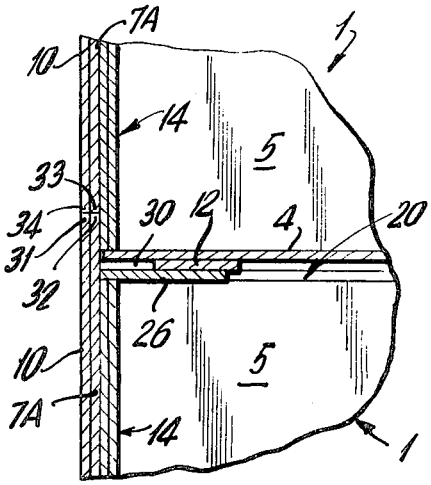
FIG. 15 is a sectional view taken along line 15—15 of FIG. 14.

The cover portion 3 is then mounted over the open tray 2 and the side flaps 21 folded down and adhered to the side walls 5 of the tray 2 (FIGS. 10 and 11). The cover portion has offset slots 35 extending inwardly from its side edges to accommodate the stack tabs 31–32. The top flaps 12 are then folded over the top wall portions 26 of the cover assembly 2 and adhered to the outer top wall areas 26 (FIG. 13). Since the stack tabs 31 are formed by a slot 30 in the top flaps 12, the bending of the top flaps 12 will not affect the stack flaps 31 which will remain in their upstanding position together with the stack tabs 32 which are adhered thereto.

When containers 1 are to be stacked, the stack tabs 31–32 of one container will be received into the stack slots 33–34 of the container above it (FIGS. 14 and 15) so that the containers are locked with respect to each other.

It will thus be seen that the present invention provides an improved fiberboard container for fresh produce which is strong enough to withstand handling during shipment and which is provided with means for easily opening and reclosing the cover so that the contents may be inspected.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A container comprising a tray and a cover, said tray having a bottom wall, opposed end walls and opposed side walls, each of said end walls having an upstanding top flap, each said top flap having a free edge remote from its respective side wall, said cover comprising a top wall and a pair of parallel side flaps extending from opposed side edges thereof, said top wall having opposed top wall end areas normal to said side flaps and defined by parallel tear lines spaced inwardly from respective side edges normal to said opposed side edges, said tear lines substantially underlyingly aligned with the respective free edges of said top flaps, said side flaps being attached to the outside of said side walls of said tray, said top flaps being folded over said top wall end areas and attached to said end area.

2. A container as claimed in claim 1, wherein said tear lines in said top wall form closure panels between said top wall end areas.

3. A container as claimed in claim 2 wherein said tear lines extend across the entire width of said top wall.

4. A container as claimed in claim 3, wherein the width and length of said top flaps are substantially equal to the width and length of said top wall end areas.

5. A container as claimed in claim 4 wherein an opening is provided in said top wall.

6. A container as claimed in claim 5, wherein said opening is elongated and extends from one tear line to the other.

7. A container as claimed in claim 1, wherein said side flaps are adhered to said tray side walls, said top flaps are adhered to said top wall end areas, and end flaps are provided on the ends of said side walls and adhered to said end walls.

8. A container as in claim 1, wherein a stack tab extends upwardly from each end wall and wherein a stack slot is provided adjacent the lower edge of each end wall to receive said stack tab when one container is stacked on another.

9. A container as claimed in claim 1, wherein support panels are attached to the end flaps of the container.

* * * * *